United States Patent [19]

Saitoh

[11] 4,453,833

[45] Jun. 12, 1984

[54] MOVEMENT STRUCTURE FOR HAND DISPLAY TYPE ELECTRONIC WATCH

[75] Inventor: Mitsuo Saitoh, Tanashi, Japan

[73] Assignee: Citizen Watch Company Limited, Tokyo, Japan

[21] Appl. No.: 235,383

[22] Filed: Feb. 17, 1981

[30] Foreign Application Priority Data

| | | | |
|---|---|---|---|
| Feb. 19, 1980 | [JP] | Japan | 55-20223[U] |
| Feb. 22, 1980 | [JP] | Japan | 55-22172[U] |
| Nov. 28, 1980 | [JP] | Japan | 55-170558[U] |

[51] Int. Cl.[3] ..... G04C 10/02; G04B 29/02

[52] U.S. Cl. ..... 368/88; 368/204

[58] Field of Search ..... 368/76, 80, 88, 203, 368/204

[56] References Cited

U.S. PATENT DOCUMENTS

| | | | |
|---|---|---|---|
| 4,079,582 | 3/1978 | Tamaru et al. | 368/204 |
| 4,087,957 | 5/1978 | Miyasaka et al. | 368/204 |
| 4,249,251 | 2/1981 | Wuthrich | 368/76 |

FOREIGN PATENT DOCUMENTS

| | | | |
|---|---|---|---|
| 52-23967 | 2/1977 | Japan | 368/88 |
| 55-40927 | 3/1980 | Japan | 368/88 |
| 55-42036 | 3/1980 | Japan | 368/88 |
| 2052809 | 1/1981 | United Kingdom | 368/76 |

*Primary Examiner*—Forester W. Isen

*Attorney, Agent, or Firm*—Jordan and Hamburg

[57] ABSTRACT

A movement structure for an analog display type electronic watch powered by a coin-shaped lithium cell. The movement structure comprises a base plate of a synthetic resin. The base plate has an integral lug portion which engages with and support the battery cell in a fixed place.

3 Claims, 4 Drawing Figures

MOVEMENT STRUCTURE FOR HAND DISPLAY TYPE ELECTRONIC WATCH

BACKGROUND OF THE INVENTION

The present invention relates to the structure of a hand display type electronic watch equipped with a so-called coin-shaped lithium battery cell or like flat cell which has a relatively large energy capacity per unit volume and a large diameter compared with its thickness (meaning a relatively large area as viewed in a plan).

A current trend in the art of watches of hand display type is the use of a quartz oscillation circuit as a time standard oscillator and a stepping motor or like electromechanical transducer for driving a wheel train and associated hands.

Conventional hand display type quartz watches, however, require cell replacement which is repeated in every short period of time. This is because they are powered by so-called button-shaped silver battery cells (silver oxide cells or silver peroxide cells) having an energy capacity per unit volume smaller than that of the coin-shaped lithium cells; the service life of a button-shaped silver cell is generally as short as two to three years. Another problem attributable to the use of such a silver cell is that its inherent structure is liable to cause leakage of the electrolyte which would invite serious failures in the circuitry, wheel train and other sections of the watch.

Meanwhile, coin-shaped lithium cells have recently been spotlighted as power sources for various portable electronic instruments including electronic watches of digital display type and electronic desk-top calculators. Compared with a button-shaped silver cell, a coin-shaped lithium cell has a smaller rate of natural deterioration caused by self-discharge, a large energy capacity per unit volume, and a far less possibility of leakage of the electrolyte. Despite these advantages, a lithium cell has not so far been installed in electronic watches of hand display type.

A lithium cell increases its internal resistance as its thickness is increased. With this in view, a lithium cell particularly for use in a watch must be provided with a coin-like shape which is relatively thin and has a sufficiently large diameter compared with the thickness.

A coin-shaped lithium cell preferable for a watch may be about 16–25 mm in diameter, about 0.6–2.5 mm in thickness and 0.8–4.0 g in weight. In this connection, a watch for men employs a plate whose diameter generally ranges from about 23 mm to 28 mm. Considering these dimensions, it will be understood that the practical use of a coin-shaped lithium cell with a hand display electronic watch is difficult unless how the cell should be arranged and supported in the watch is settled.

Different from a digital display electronic watch, a hand display electronic watch includes a wheel train driven by an electromechanical transducer and located in a position adjacent to a substantially central part of the plate in a plan view and intervening between the plate and wheel train support in a sectional view. It will thus be apparent from the relationship between the diameter of the plate and that of the coin-shaped lithium cell that the lithium cell in a hand display electronic watch must be layed over the space which has accommodated the wheel train and wheel train support. To meet this requirement, there must be settled two different problems altogether: how the various elements of such a watch should be layed out to prevent a disproportionate increase in the overall thickness of the watch and intricacy of its construction, and how the cell should be supported to cope with impact forces applied from the outside to the watch without imparting the resultant impacts from the cell directly to the wheel train which constitutes a movable part of the watch.

Generally, a watch is accepted as more valuable as its thickness decreases. In case where use is made of a coin-shaped lithium cell having the aforementioned dimensions, the ratio of the diameter d of the cell to that D of the plate is approximately within the range of $0.65 \leqq d/D \leqq 0.95$ so that the cell in the watch ineviatably overlaps a major part of the other elements of the watch. This requires a specially designed arrangement and structure which avoids an increase in the thickness of the watch.

A hand display watch also differs from a digital display watch in that it includes a part of the electromechanical transducer, wheel train or like movable section which performs rotation or like mechanical motion through a delicately designed support structure. It follows that, where it is intended to overlay a heavy lithium cell on such movable sections, there must be avoided a structure which permits an impact force attributable to the presence of the cell to directly reach and damage the movable sections. Indeed, it has already been proposed to provide an unusual structure to the back cover and hold a flat cell inside the back cover, or to interpose a second back cover between the movement and a first back cover and accommodate a flat cell between the first and second back covers. Though these known structures succeed in preventing an impact load from the cell from reaching the movable sections when an impact due to dropping or the like is applied to the watch, they add to the intricacy of construction and therefore to the production cost while making the entire watch very thick. For these reasons, hand display electronic watches using lithium cells have not been put to practical use.

SUMMARY OF THE INVENTION

It is, therefore, an object of the present invention to provide a movement structure for an analog quartz timepiece powered by a coin-shaped lithium battery cell. More specifically, a primary object of the present invention is to provide an improved structure which can accommodate a coin-shaped lithium cell or like flat cell while minimizing an increase in the thickness of the watch and intricacy of construction.

Another object of the present invention is to provide a supporting structure which, when the watch is subjected to an impact due to dropping or the like, prevents an impact load derived from the flat cell from directly contacting and damaging a wheel train and like movable sections of the watch. The present invention thus realizes a hand display electronic watch powered by a coin-shaped lithium cell which is large in energy capacity and very low in frequency of leakage of its fluid.

DETAILED DESCRIPTION OF THE PREFERRED EMBODIMENT

Before entering into detailed description of the present invention, a prior art movement structure will be discussed with reference to FIG. 1 of the drawings.

Figure 1:
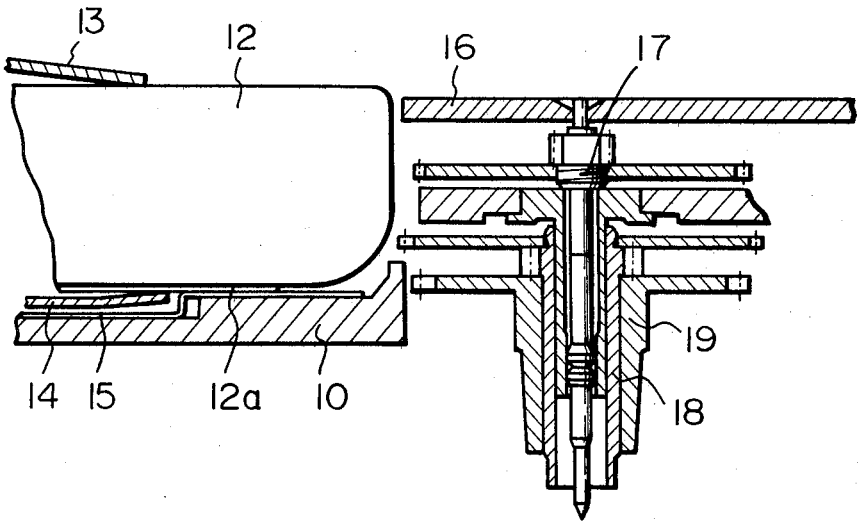
Fig. 1 PRIOR ART
FIG. 1 is a partial cross-sectional view of an example of a prior art movement structure of an analog display quartz watch.

FIG. 1 shows in fragmentary section a structure of a part of a conventional watch movement adapted to accommodate a button-type battery cell therein. The movement structure includes a plate 10, a cell 12 having a negative electrode section 12*a*, a first spring 13 for pressing the cell 12 at the positive electrode side of the latter, a second spring 14 serving to bear the cell 12 at the negative electrode side, and a flat insulator 15 adapted to avoid a short-circuit across the negative and positive electrodes of the cell 12. Also included in the movement structure are a wheel train bridge 16 for a wheel train, a fourth wheel and pinion 17 for mounting a second hand (not shown) thereon, a center wheel and pinion 18 for mounting a minute hand (not shown), and an hour wheel 19 adapted to carry an hour hand (not shown).

It will be seen from FIG. 1 that a cell in a conventional watch is so arranged as to avoid its overlapping relation with the various components of the watch such as the wheel train bridge 16, fourth wheel and pinion 17, center wheel and pinion 18 and hour wheel 19 as viewed in a plan. This is to make the movement of the watch as thin as possible as already stated. Meanwhile, there is a keen demand for a cell capable of a long time of service which has originated from the recent rising price of cells as well as ordinary user's desire. Particularly, such a prolonged service life of a cell is indispensable in those areas of the international market which have not yet been prepared for full services for the replacement of cells and like maintenance. A watch currently desired is therefore one which has a smartly proportioned case with reduced dimensions in plan and section while employing a cell of a large capacity. The known cell support structure of FIG. 1 cannot accommodate increases in the outside diameter of the cell; the upper limit of the diameter is about 12 mm considering the outside diameters of standard watches for men. Therefore, the service life of a cell available for the known structure concerned is about 3–5 years at the most.

A preferred embodiment of a movement structure according to the present invention will be described with reference to FIG. 2 of the drawings.

Figure 2:
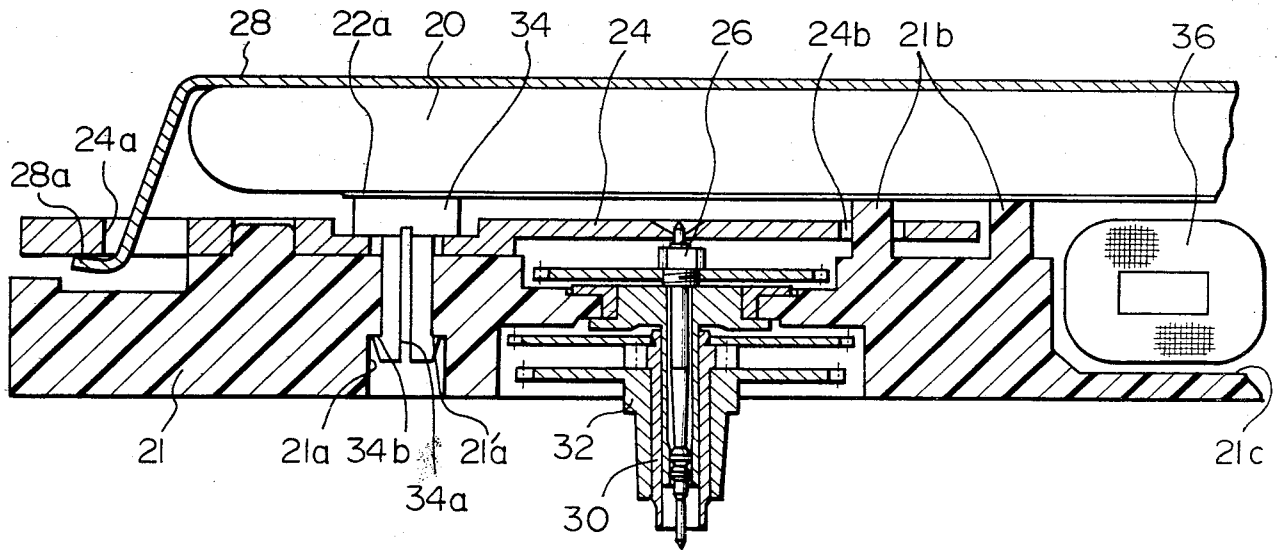
FIG. 2 is a partial cross-sectional view of a preferred embodiment of a movement structure of an analog display quartz watch according to the present invention.

Referring to FIG. 2, the movement structure includes a base plate 21 made of a synthetic resin. A flat coin-shaped lithium battery cell 20 having a negative electrode section 22*a* is disposed above a metallic wheel train bridge 24 and a fourth wheel and pinion 26. A battery retaining or pressure spring 28 at the positive electrode side of the cell 20 resiliently secures the cell to the movement of the watch while setting up electric conduction between the positive and negative electrodes of the cell. The spring 28 extends through an opening 24*a* of the wheel train bridge 24 and is secured to the wheel train bridge 24 through its end portion 28*a* projecting from the opening 24*a*. The fourth wheel and pinion 26 carries a seconds hand (not shown) thereon. Reference numeral 30 indicates a center wheel and pinion for mounting a minute hand (not shown), and 32 an hour wheel for carrying an hour hand (not shown) therewith. A base plate 21 is formed with a through bore 21*a* having a shoulder 21′*a*. A fastener 34 made of a resin extends through the bore 21*a* of the base plate 21 and has its radial flange 34*b* hooked to shoulder 21′*a* of the bore with the aid of a slit 34*a* which makes the fastener resilient. The fastener 34 serves not only to secure the wheel train bridge 24 to the plate 21 but to bear the bottom of the cell 20 in cooperation with lug or projections portions 21*b* provided to the plate 21. Moulded integrally with the plate 21, the lug portions 21*b* extend upward as viewed in FIG. 2 beyond the upper surface of the wheel train bridge 24. As shown, one of the lugs 21*b* extends through an opening 24*b* formed in the wheel train bridge 24 so that it can support the bottom of the cell 20 in an optimum position. Since the plate 21 and fastener 34 are made of a non-conductive material such as synthetic resin, they eliminate the need to place an additional insulator beneath the negative electrode section 2*a* of the cell and function to absorb forces resulting from shocks and impacts applied to the watch from the outside. The base plate 21 has a cutout 21*c* in which a drive coil 36 is received.

In summary, in a hand display type electronic watch having a plate of synthetic resin and a metallic wheel train bridge layed on the base plate, the present invention provides a cell support structure for a watch of the type described in which the plate has lug sections moulded integrally therewith and projecting upward beyond the upper surface of the wheel train bridge. The lugs of the plate support at least a part of a coin-shaped lithium cell or like flat cell which is loaded in the watch at a level higher than the wheel train support.

Accordingly, the location of the coin-shaped cell above the wheel train bridge readily permits the use of a cell having relatively large diameter and capacity. When an impact force is applied from the outside to a watch constructed according to the invention, the resultant load from the heavy cell is not imparted directly to the relatively weak wheel train bridge but absorbed by the lug portions integral with the plate formed of a synthetic resin and, in this way, prevented from damaging the various wheels and other component parts of the watch. A large diameter cell thus become available covers even the top of a coil installed in a watch of the type described and thereby improves the resistance of the watch to the magnetism. Additionally, a watch using a coin-shaped lithium cell or the like having a large capacity needs cell replacement only once in seven to ten years which is contrastive to the conventional three to five years of interval. This is pleasing in various respects such as practical use of such watches and saving of natural resources.

The plate can be made of a synthetic resin or a metal as desired because its thickness is large enough to ensure a sufficient mechanical strength. Concerning the wheel train bridge, however, it is relatively thin and generally needs be formed of a metal to have a desired mechanical strength. Despite the use of a metallic wheel train bridge, the present invention requires no additional insulators for isolating the wheel train bridge and cell from each other because the contact between the bottom of the cell and the wheel train bridge is blocked by the lug portions of the plate made of a synthetic resin.

Figure 3:
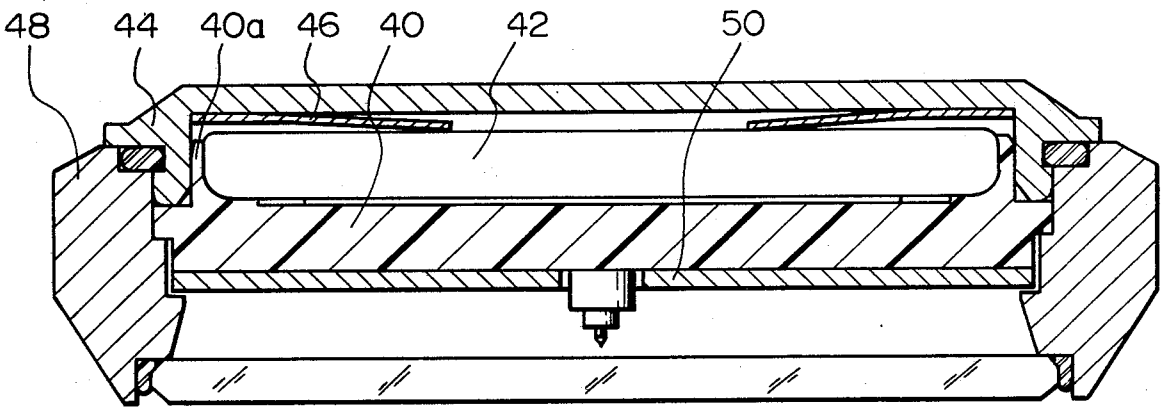
FIG. 3 is similar to FIG. 2 best shows another preferred embodiment of a watch movement structure according to the present invention.

Referring to FIG. 3 there is shown another preferred embodiment of the cell support structure according to the present invention.

The structure of FIG. 3 includes a base plate 40 formed of a mouldable synthetic resin and having a lug or projecting portion 40*a* adjacent to its outer edge. A flat cell 42 is layed on the plate 40 and retained by the lug portion 40*a* in a fixed position. The lug portion 40*a* in the illustrated embodiment is adapted to strongly press the outer periphery of the flat cell 42. If desired, however, it may have a design to temporarily hold the cell 42 before a movement is introduced into the case and then be urged radially inward by a back cover 44 which will be attached to the case as usual. The back cover 44 in this alternative design will serve as a hoop and positively fix the cell in place when the watch is completed. With any of these constructions according to the invention, a watch is operable in a stable manner without any accidents attributable to unstable support for a cell such as momentary stops resulting from shocks and impacts which might be applied to the watch put on the wrist. A cell pressing or retaining spring 46 is welded, fitted or otherwise secured to the back cover 44. The watch in FIG. 3 further includes a case band 48 and a dial plate 50.

In the embodiment of FIG. 3, a cell is layed on a base plate of the watch and retained by a lug portion 40*a* formed integrally in a part of the plate which is made of a synthetic resin. Such a design of cell support structure successfully secures a coin-shaped lithium or like flat cell having a relatively large outside diameter without resort to additional members for supporting the cell. The resultant marked increase in the available cell capacity significantly prolongs the service life of a cell installed in an electronic watch. This not only frees ordinary users from the concern about the replacement of cells which has constituted the most critical problem in electronic watches but affords an advantage in saving natural resources.

Figure 4:
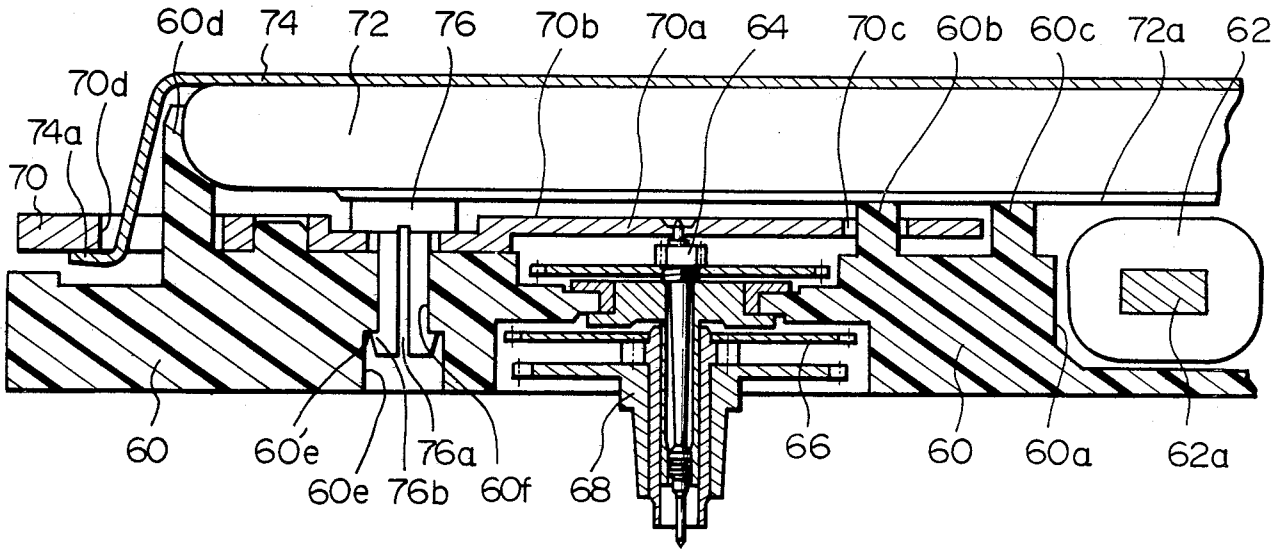
FIG. 4 shows in cross-sectional another preferred embodiment of a watch movement structure according to the present invention.

Referring to FIG. 4, there is shown in section another preferred embodiment of a movement structure of a hand display type quartz watch according to the present invention. The movement structure includes a base plate 60 formed by injection moulding of a synthetic resin and provided with a recess 60*a* in a part thereof. A drive coil 62 is placed in the recess 60*a* of the base plate 60 to constitute a part of a stepping motor in combination with a known stator and rotor (not shown). The rotor or mechanical output means of the motor is adapted to drive a series of wheel train mechanism made up of a fifth wheel and pinion, a fourth wheel and pinion (seconds hand wheel) 64, a third wheel and pinion, a center wheel and pinion with cannon-pinion (minute hand wheel) 66, a minute wheel and an hour wheel 68.

The wheel train mentioned above is located in registry with a substantially central part of the base plate 60 though the fifth wheel and pinion, third wheel and pinion and minute wheel are not shown in the drawing. At least the fifth wheel and pinion and the third wheel and pinion of the wheel train are disposed above the base plate 60 as viewed in FIG. 4. These wheels above the plate 60 have their associated upper shaft held rotatably by a flat portion 70*a* of a metallic wheel train bridge 70 and their lower shaft by the base plate 60.

First lug or projecting portions 60*b* and 60*c* are moulded integrally with the base plate 60 and project therefrom in positional correspondence with a side of a coin-shaped flat battery cell 72 that forms the lower end as will be described hereinafter. A second lug or projecting portion 60*d* also extends from the base plate 60 and engages the peripheral wall of the cell 72.

As viewed in FIG. 4, the first lugs 60*b* and 60*c* commonly extend upward beyond the upper surface 70*b* of the bearing part 70*a* of the wheel train bridge whereas the second lug 60*d* protrudes further upward beyond the plane which contains the upper ends of the first lugs 60*b* and 60*c*. The flat cell 72 in the form of a so-called coin-shaped lithium cell is positioned above the wheel train bridge 70 with its negative electrode side 72*a* faced downward. It will thus be seen that the first and second lugs of the base plate 60 serve to position and support the flat cell 72. More specifically, the first lugs 60*b* and 60*c* support at least a part of the bottom of the cell 72 while the second lug 60*d* retains the periphery of the cell 72 to locate it in the diametrical direction. As shown, one 60*b* of the two first lugs extends through an opening 70*c* provided in the wheel train bridge 70 so that it can support the bottom of the cell 72 in an optimum position.

The base plate 60 also has a through bore 60*e* having a shoulder portion 60'*e*. A fastener 76 made of a resin extends through bore 60*f* of the base plate 60 and has its radial flange 76*b* hooked to the shoulder 60'*e* of the bore with the aid of a slit 76*a* which makes the fastener resilient. The fastener 76 serves not only to secure the wheel train bridge 70 to the plate 60 but to bear the bottom of the cell 72 in cooperation with the first lugs 60*b* and 60*c* of the base plate 60.

The reference numeral 74 denotes a pressure spring adapted to press the cell 72 from above. The pressure spring 74 extends through an opening 70*d* formed in the wheel train bridge 70 and is hooked through its end portion 74*a* to the bottom of the wheel train bridge as illustrated in FIG. 4.

The construction shown and described thus permits a coin-shaped lithium cell or like flat cell to be fixed in place above a wheel train bridge through a very simple support structure. This promotes the use of cells having relatively large diameters and capacities in electronic watches of hand display type. When an impact force is applied from outside to a watch constructed according to the invention, the resultant load from the heavy cell is not imparted directly to the relatively weak wheel train bridge but absorbed by the lug portions integral with the base plate formed of a synthetic resin and in this way prevented from damaging the various wheels and other component parts of the watch. A large diameter cell thus become available covers even the top of the coil 62 and thereby protects the coil against forces which may be applied to the watch from the outside. Since a cell is generally formed of a magnetically permeable material, a cell having such a large diameter also functions as a magnetic shield plate which affords the watch an improved resistance to the magnetism. Naturally, a watch using a coin-shaped lithium cell or the like having a large capacity needs cell replacement only once during a period of from seven to ten years which is contrastive to the conventional three to five years of interval.

The base plate can be made of a synthetic resin or a metal as desired because its thickness is large enough to ensure a sufficient mechanical strength. Concerning the wheel train bridge, however, it is relatively thin and generally needs be formed of a metal to have a desired mechanical strength. Despite the use of a metallic wheel train support, the present invention requires no additional insulators for isolating the wheel train bridge and cell from each other because the contact between the bottom of the cell and the wheel train support is blocked by the lug portions of the base plate made of a synthetic resin.

The first lugs of the base plate for supporting the bottom of the cell should preferably be located in positions where they efficiently support the cell. For instance, they may be positioned in spaced locations in such a manner as to surround a region in which the wheel train mechanism is disposed. The same holds true for the second lug adapted to diametrically position the cell by holding the periphery of the latter. The second lug may comprise spaced lug sections arranged along the periphery of the cell or a pair of arcutate lug sections which diametrically oppose each other.

What is claimed is:

1. A movement structure for an analog quartz timepiece powered by a coin-shaped lithium cell, comprising:

a baseplate formed of a synthetic resin and having a first central cutout portion and a second cutout formed therein;

a wheel train bridge secured to one side of said baseplate;

a drive coil disposed in said second cutout;

said baseplate further having support lugs formed extending from one side thereof upward beyond an upper surface of said wheel train bridge;

a wheel train block received in said first cutout portion and at least partially retained by said wheel train bridge, said wheel train block being provided with at least one pinion for mounting a time indicating hand on one end thereof, said pinion end being disposed protruding outward from said wheel train block on the opposite side of said baseplate from said side formed with said support lugs;

said lithium cell being located above said wheel train block and said drive coil so as to provide a space between said wheel train bridge and said drive coil, and said lithium cell, with a bottom surface of said cell being positioned and supported by said support lugs, said drive coil and said wheel train bridge lying entirely on one side of a plane containing said bottom surface.

2. A movement structure according to claim 1, in which said support lugs engage an outer periphery of said lithium cell to laterally position said cell.

3. A movement structure according to claim 1, further comprising a retaining spring having one end thereof engaging said wheel train bridge, for retaining said lithium cell against said support lugs.

* * * * *